US006446953B1

(12) United States Patent
Felix et al.

(10) Patent No.: US 6,446,953 B1
(45) Date of Patent: Sep. 10, 2002

(54) PROCESS FOR COMBINING PRINTED PRODUCTS

(75) Inventors: Markus Felix, Uster; Erwin Müller, Dürnten, both of (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/502,611

(22) Filed: Feb. 11, 2000

(30) Foreign Application Priority Data

Feb. 15, 1999 (CH) ..... 0284/99

(51) Int. Cl.[7] ..... B65H 39/00

(52) U.S. Cl. ..... 270/52.19; 270/52.01; 270/52.2

(58) Field of Search ..... 271/204, 205, 271/206, 82, 85; 270/52.01, 52.02, 52.03, 52.19, 52.2, 52.21, 52.22, 58.01, 58.23

(56) References Cited

U.S. PATENT DOCUMENTS 3,966,186 A * 6/1976 Helm ..... 270/52.02
4,489,930 A * 12/1984 Meier ..... 270/52.3
4,552,349 A 11/1985 Loos et al.
4,706,951 A * 11/1987 Leu ..... 270/52.22
4,743,005 A * 5/1988 Reist ..... 270/52.22
4,866,910 A 9/1989 Reist
5,007,624 A 4/1991 Chandhoke
5,019,716 A * 5/1991 Meier ..... 270/52.2
5,098,076 A 3/1992 Kelsey
5,188,349 A * 2/1993 Honegger ..... 270/52.22
5,280,895 A 1/1994 Meier
5,657,979 A 8/1997 Bruce et al.
5,660,382 A 8/1997 Meier
5,732,939 A * 3/1998 Meier ..... 270/52.01
5,746,425 A 5/1998 Flannery, Jr.
5,758,871 A * 6/1998 Schlough ..... 270/52.22
5,957,449 A * 9/1999 Luthi ..... 271/204

FOREIGN PATENT DOCUMENTS

EP 0 272 398 A1 6/1988

* cited by examiner

*Primary Examiner*—Christopher P. Ellis
*Assistant Examiner*—Patrick Mackey
(74) *Attorney, Agent, or Firm*—Alston & Bird LLP

(57) ABSTRACT

A process for combining a plurality of completed printed products such as completed newspapers and/or periodicals, into bundles. At least two storage arrangements are provided, which are occupied by completed printed products of different types. The products are retrieved individually from the storage arrangements in a sequence which is necessary for forming bundles which are composed of a particular distribution of the products. The retrieved products are fed to a receiving conveyor, with certain products being positioned upstream of, or between, products which have already been fed to the receiving conveyor, and the products which follow one after the other in the region of the receiving conveyor are combined into the bundles.

28 Claims, 7 Drawing Sheets

Figure 1:
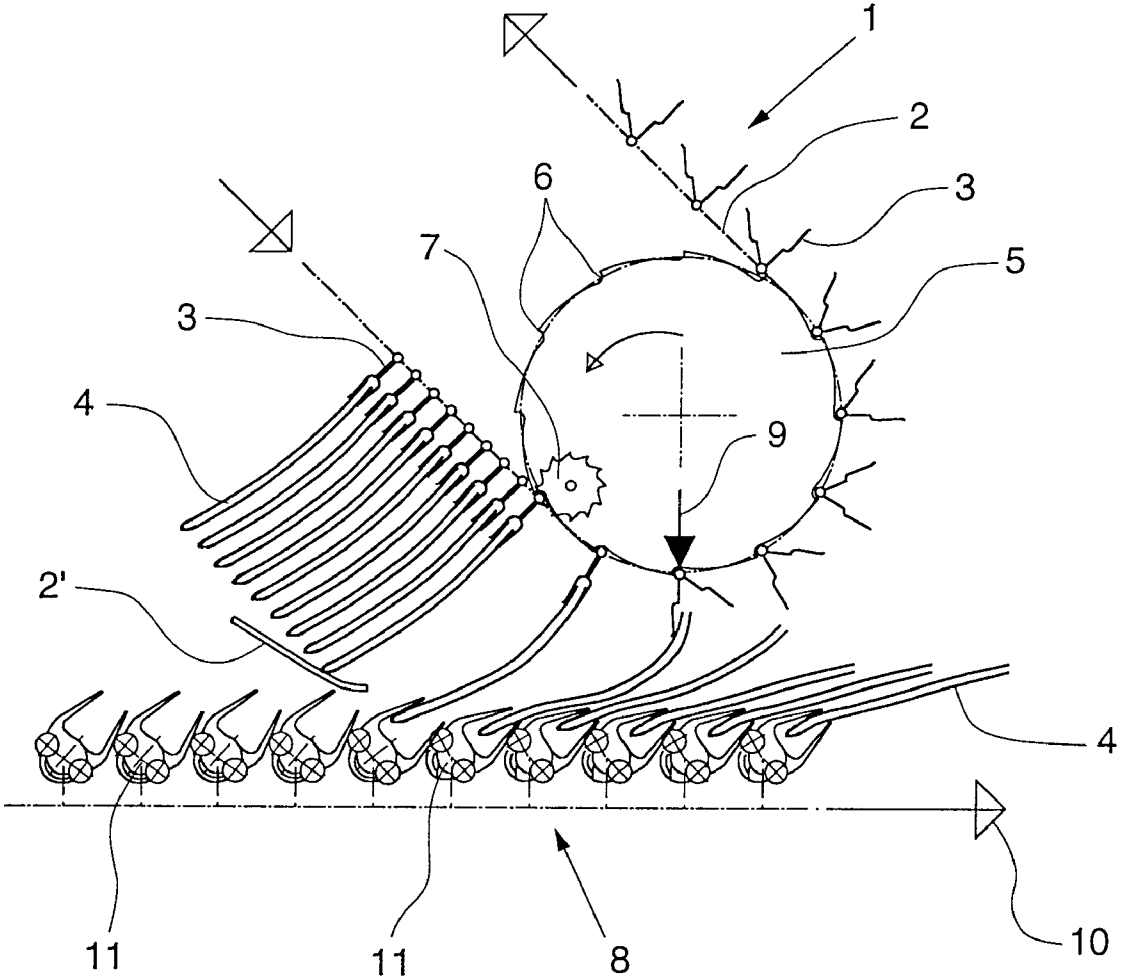

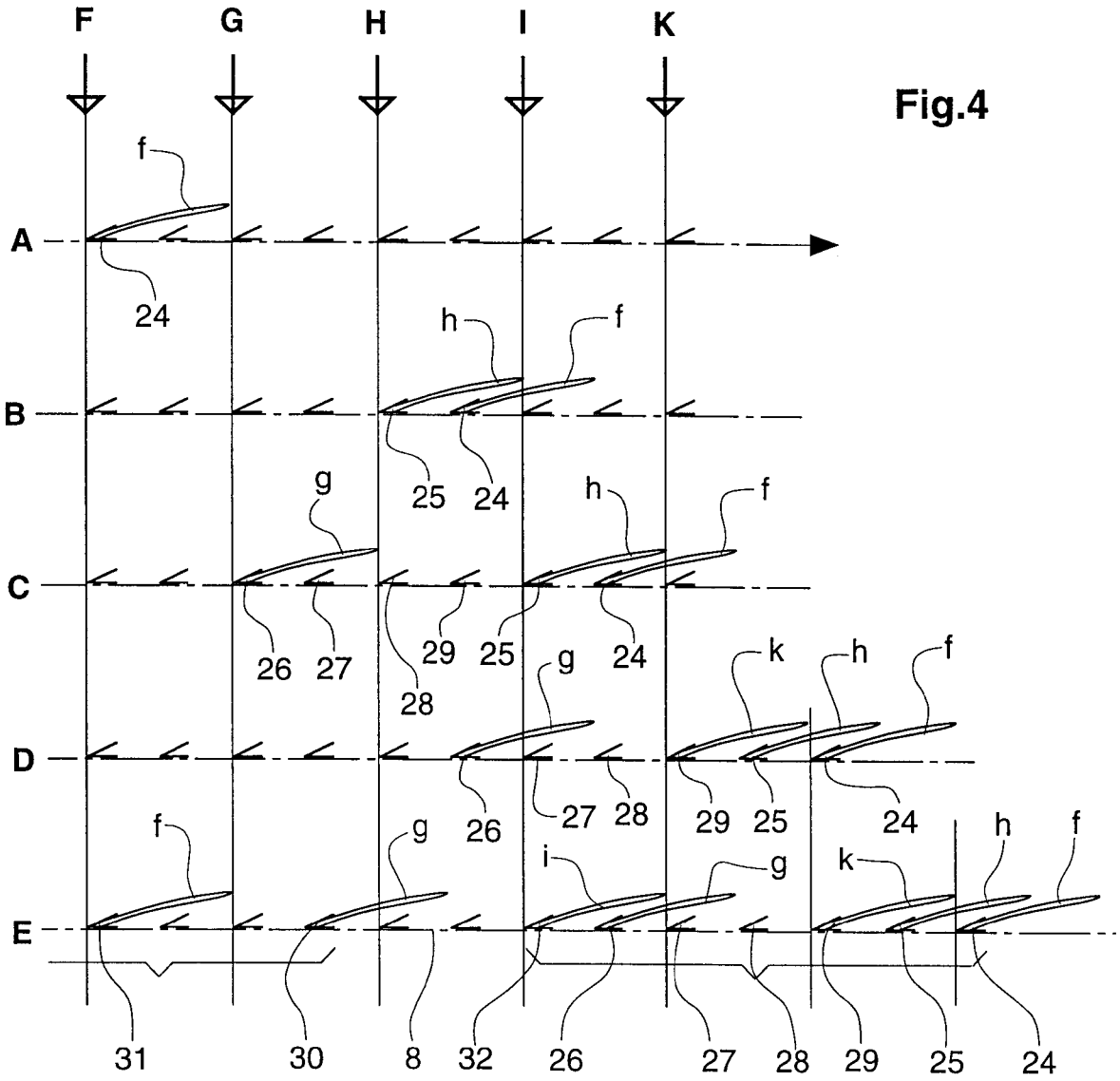
Fig.4
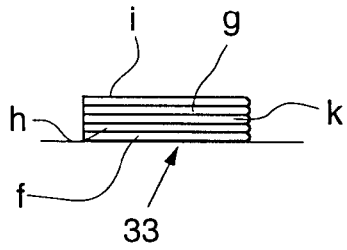

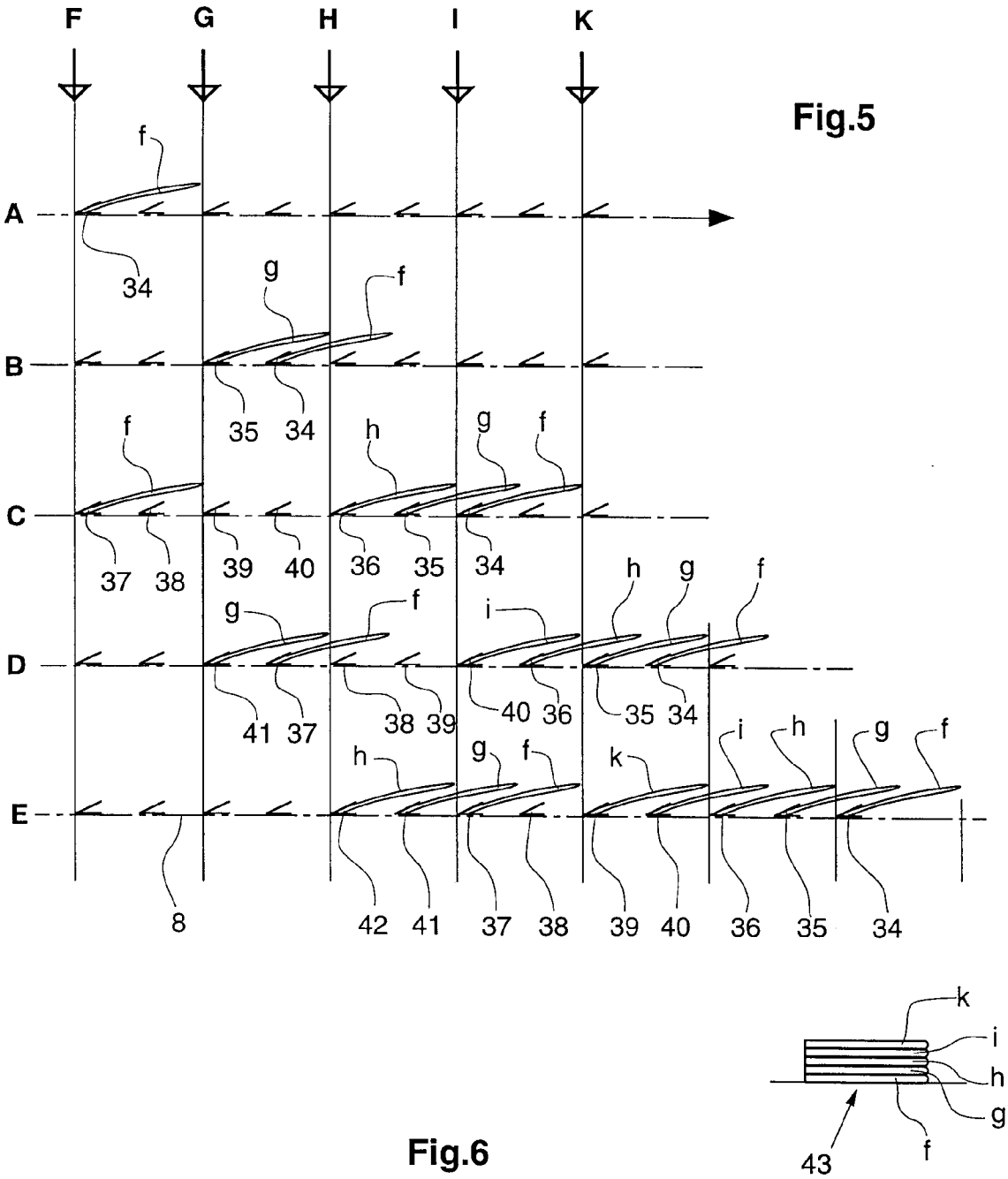
Fig.5
Fig.6
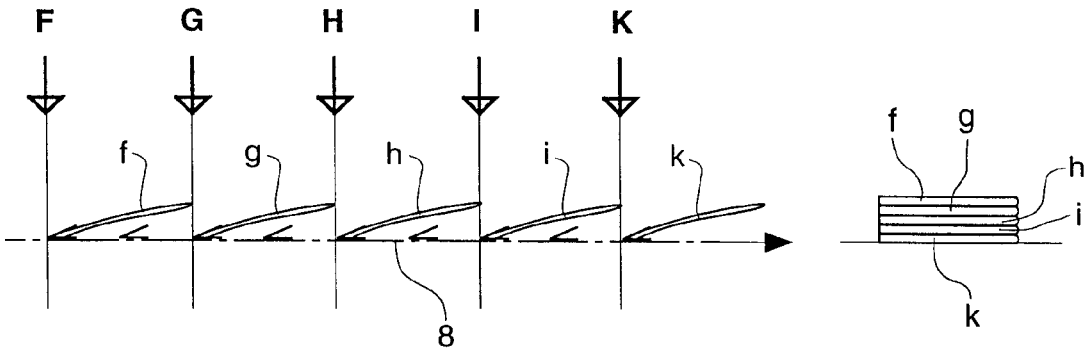

PROCESS FOR COMBINING PRINTED PRODUCTS

BACKGROUND OF THE INVENTION

The invention relates to a process for combining a plurality of completed printed products, in particular completed newspapers and/or periodicals, into bundles, in the case of which completed printed products are retrieved from at least two storage arrangements and fed to a receiving conveyor, whereupon the products which follow one after the other in the region of the receiving conveyor are combined into bundles. Completed printed products are, in particular, end products which have already been combined.

Such a process is known from European Patent EP 0 272 398 B1 and U.S. Pat. No. 4,866,910. According to these patents, there are provided a plurality of storage arrangements which are designed as winding stations and transfer products to a receiving conveyor, it being possible for, for example, a fork-lift truck or a delivery truck to be provided at the outlet of the receiving conveyor in order to receive the products.

The disadvantage with this is that the sequence in which the products are arranged on the receiving conveyor is not highly flexible. In particular, it is not possible for products which follow one after the other on the receiving conveyor and each have an individual, different composition to be combined into bundles.

It is an object of the invention to develop a process of the type mentioned in the introduction such that it is possible to combine, with the highest possible level of flexibility, bundles which differ from one another in terms of type, number and/or sequence of the products which follow one after the other within a bundle.

SUMMARY OF THE INVENTION

The above and other objects and advantages are achieved according to the invention in that from at least two storage arrangements, which are occupied by completed printed products of different types, products are retrieved individually from the storage arrangements in a sequence which is necessary in each case for a bundle which is to be combined. The retrieved products are fed to a receiving conveyor, with certain products being positioned upstream of, or between, products which have already been fed to the receiving conveyor, and the products which follow one after the other in the region of the receiving conveyor are combined into bundles.

According to the present invention, the storage arrangements are thus designed such that, in accordance with requirements, individual products can be retrieved, and fed to the receiving conveyor, at the necessary points in time in each case, it being possible for the products retrieved, depending on requirements, to be positioned not just at the end of the products which follow one after the other on the receiving conveyor but also upstream of, or between, products which have already been fed to the receiving conveyor.

The capacity for individually retrieving the products from the storage arrangements makes it possible to combine, for each individual bundle, products which differ from one another in terms of type and the number thereof which occur in the respective bundle.

Depositing products upstream of, or between, products which have already been positioned on the receiving conveyor makes it possible, on the one hand, to vary to a considerable extent the sequence of the products which follow one after the other within a bundle and, on the other hand, to position on the receiving conveyor a comparatively high number of products per length section of the receiving conveyor, with the result that it is possible to achieve maximum utilization of the receiving conveyor.

The process according to the invention thus makes it possible to combine individual bundles in which the number, type and sequence of products correspond, for example, precisely to the route of an individual who delivers newspapers or periodicals, it being possible for bundles which follow directly one after the other to be structured completely differently —depending on the order route.

It is preferred if receiving positions which follow one after the other are defined in the region of the receiving conveyor, each receiving position being suitable for receiving precisely one product or else a plurality of products. By defining receiving positions in this way, it being possible for said positions to follow one after the other in an equidistant manner, in particular, in the region of the receiving conveyor, the process according to the invention is easier to carry out since, with knowledge of the receiving positions which are present per length unit of the receiving conveyor, it is easier to determine or calculate the time sequence of the product transfers taking place from the storage arrangements to the receiving conveyor.

It is particularly advantageous if each product fed to a receiving position is retained actively, in particular by means of a clamp or a gripper, therein since this makes it possible for products to be transferred quickly and reliably from the storage arrangements to the receiving positions without the products being able to slip, for example, in the region of the receiving conveyor. In particular, in the case of this variant, individual further processing of the products transported on the receiving conveyor is possible since the products, which are retained individually by means of clamps or grippers, can easily be fed to different further-processing processes.

Products can be transferred particularly easily from the storage arrangements to the receiving positions of the receiving conveyor if each product fed to a receiving position is retained from beneath, for example, by means of a gripper or of a clamp, with the result that the products are transported in a lying or standing, but not hanging, position in the region of the receiving conveyor.

As an alternative to the products being actively retained, however, it is also possible for the receiving conveyor to be designed as a straightforward conveying belt, as a belt with protrusions or as an arrangement of product pockets which follow one after the other.

In order to ensure that the products are transferred from the storage arrangements to the receiving conveyor in a friction-free manner, said transfer of products may be controlled such that products are only ever transferred in each case to free receiving positions not yet occupied by a product. This makes it possible to avoid the situation where one receiving position is assigned two or more products. Alternatively, however, it is also possible, in certain situations, for one receiving position to be specifically assigned two or more products, to be precise, in particular, when the sequence of the products retained in a receiving position corresponds to the ultimately desired sequence in the bundle.

It is preferable if, before products have been combined into bundles, the time sequence in which the products are transferred from the individual storage arrangements to the receiving conveyor, or calculated by means of an optimization algorithm, is determined for each storage arrangement in dependence on the occupancy of the latter by products, the position thereof on the receiving conveyor and the desired combination of the bundles which are to be produced. This determination or calculation may be carried out both before the process according to the invention takes place and as it takes place, the last-mentioned variant also being able to take account of sudden changes to requirements.

It is particularly advantageous if, when products are fed to the receiving conveyor, gaps, i.e. "programmed" gaps, are created specifically between individual products in order for at least one further product to be fed subsequently in the region of the gaps produced. These gaps may be dimensioned specifically such that one, two or more products may be deposited subsequently in the region of the gaps, it being necessary to take into account, for the dimensioning of the gaps, both the distance between adjacent receiving positions and the length of products which have already been deposited, are projecting into the gap and thus possibly overlap certain receiving positions.

In order to allow more straightforward further processing of the bundle units which follow one after the other in the region of the receiving conveyor, it is possible for a gap to be produced in the region of the receiving conveyor between the last product of one bundle and the first product of a bundle following said bundle. Once a bundle has been delivered in full, there is thus always a certain amount of time, at the end of the receiving conveyor, for preparing for receiving a further bundle.

In an advantageous embodiment of the invention, when products are fed to the receiving conveyor, gap sections are created specifically between individual products in order for products assigned to at least one complete bundle to be fed subsequently in the region of the gap sections produced. It is thus possible for the products of one or more complete bundles to be deposited on the receiving conveyor subsequently in the region of said gap sections.

It is particularly preferred if at least individual products are dimensioned, and oriented in the region of the receiving conveyor, such that, once they have been assigned to a receiving position, they overlap at least one adjacent receiving position. This makes it possible to form, in the region of the receiving conveyor, an imbricated formation which ensures the best possible utilization of the receiving conveyor. In this case, the products may overlap at least one adjacent receiving position in the conveying direction of the receiving conveyor, that is to say that, in this case, the product, which is retained, for example, in a clamp or a gripper, precedes the clamp or the gripper in the conveying direction of the receiving conveyor.

When the abovementioned overlaps occur, it is advantageous if the transfer of products from the storage arrangements to the receiving conveyor is controlled such that products are only ever transferred in each case to free receiving positions not yet occupied by a product or not overlapped by a product. It is preferably taken into account here that different products may also have different dimensions, i.e. different products may overlap different numbers of adjacent receiving positions in each case. This ensures that, despite the overlapping which occurs, each product fed even subsequently in the region of a gap is transferred in each case to a receiving position which is ready for the receiving operation.

It is advantageous if, in the case of the abovementioned overlaps, each receiving position may be assigned three different states, namely the "free", "occupied" or "overlapped" states, since the software-related control of the process according to the invention is made easier in this way.

Even when said overlaps occur, it is possible, before products are combined into bundles, for the time sequence in which the products are transferred from the individual storage arrangements to the receiving conveyor to be determined, or calculated by means of an optimization algorithm, for each storage arrangement, to be precise in dependence on the occupancy of each storage arrangement by products, the position of the storage arrangements on the receiving conveyor, the dimensions of the products and the correspondingly produced receiving-position overlaps, and the desired combination of the bundles which are to be produced. Such a determination or calculation may also be carried out before the process according to the invention takes place and as it takes place.

It is advantageous, in principle, if the products are positioned on the receiving conveyor such that, once they have passed the last storage arrangement in the conveying direction, they overlap one another as far as possible, with the result that the bundles which are to be combined at the end of the receiving conveyor can be produced in an extremely short period of time. Accordingly, it is thus advantageous if the receiving positions of the receiving conveyor are spaced apart from one another by the smallest possible distance.

In order to avoid the abovementioned overlaps of receiving positions, it is also possible, as an alternative, to provide, between storage arrangements and receiving conveyors, guide elements which run along with the receiving conveyor and retain in a largely vertical or sloping position the products which are located on the receiving conveyor. These guide elements form pockets which are open, as it were, to the top and bottom, with the result that, on the one hand, the products retained by the guide elements may be retained from beneath by product-receiving means of the receiving conveyor and, on the other hand, products may be fed from the storage arrangements to the receiving conveyor from above.

As a further alternative, it is possible for the products to be retained in the region of the receiving conveyor in an inflected or bent state by specific grippers, such that a stiffening of the products is achieved.

Since, in the two last-mentioned cases, there are no overlaps of receiving positions of the receiving conveyor, each receiving position which is not yet occupied may in this case be fed a product at any point in time.

A high level of efficiency of the process according to the invention may be achieved, for example, when the storage arrangements along the receiving conveyor are spaced apart from one another by the smallest possible distance since, in this way, all the products may be transferred to the receiving conveyor in a comparatively short length section of the same.

Such a small distance may be achieved, in particular, by carriages which are transported along a guide path and each bear a controllable gripper. In this case, the carriages, which can be conveyed, in principle, at variable distances from one another, butt directly against one another in the region of the conveyor in order thus to permit the abovementioned small distances between them.

Preferably in each case only products of one type are stored in each individual storage arrangement, but it is also possible, in principle, to store products of different types within a storage arrangement.

The bundles which are to be produced may each contain two or more different products, but it is also easily possible for the process according to the invention to produce bundles with just one type of product.

The bundles produced according to the invention may contain different numbers of products or the same number of products. Alternatively or additionally, it is possible for the type and/or the sequence of products which follow one after the other within a bundle to differ from one another from bundle to bundle. However, it is also possible to combine bundles which are identical to one another in terms of type and/or sequence of the products which follow one after the other.

The storage arrangements used according to the invention can be used efficiently, in particular, when the products, in the region of the storage arrangement, are retained, in particular by means of clamps, in product-receiving means provided in each case for receiving just a single product. This makes it possible for individual products to be retrieved without difficulty from the storage arrangements and for the products to be transferred reliably from the storage arrangements to the receiving conveyor.

In order to achieve a maximum capacity of the storage arrangements, the product-receiving means of the storage arrangements are spaced apart from one another by the smallest possible distance.

Particularly reliable transfer of products from the storage arrangements to the receiving positions of the receiving conveyor is achieved, for example, when the products are transferred directly from the product-receiving means of the respective storage arrangement to the receiving positions of the receiving conveyor, in particular transfer from a clamp of a storage arrangement to a clamp of a receiving conveyor taking place.

For the purpose of synchronized retrieval of the products and of correspondingly simplified programming of the process according to the invention, it is possible for the storage arrangements to be given a joint transfer clock signal.

BRIEGF DESCRIPTION OF THE DRAWINGS

Figure 2:
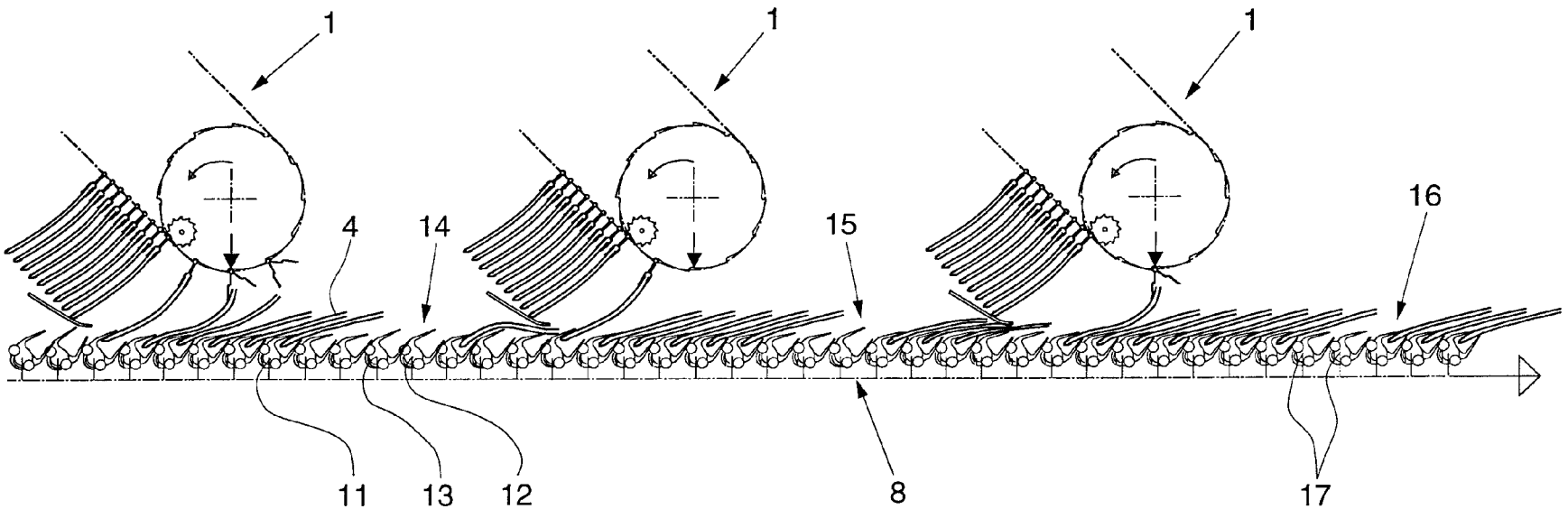
Figure 3:
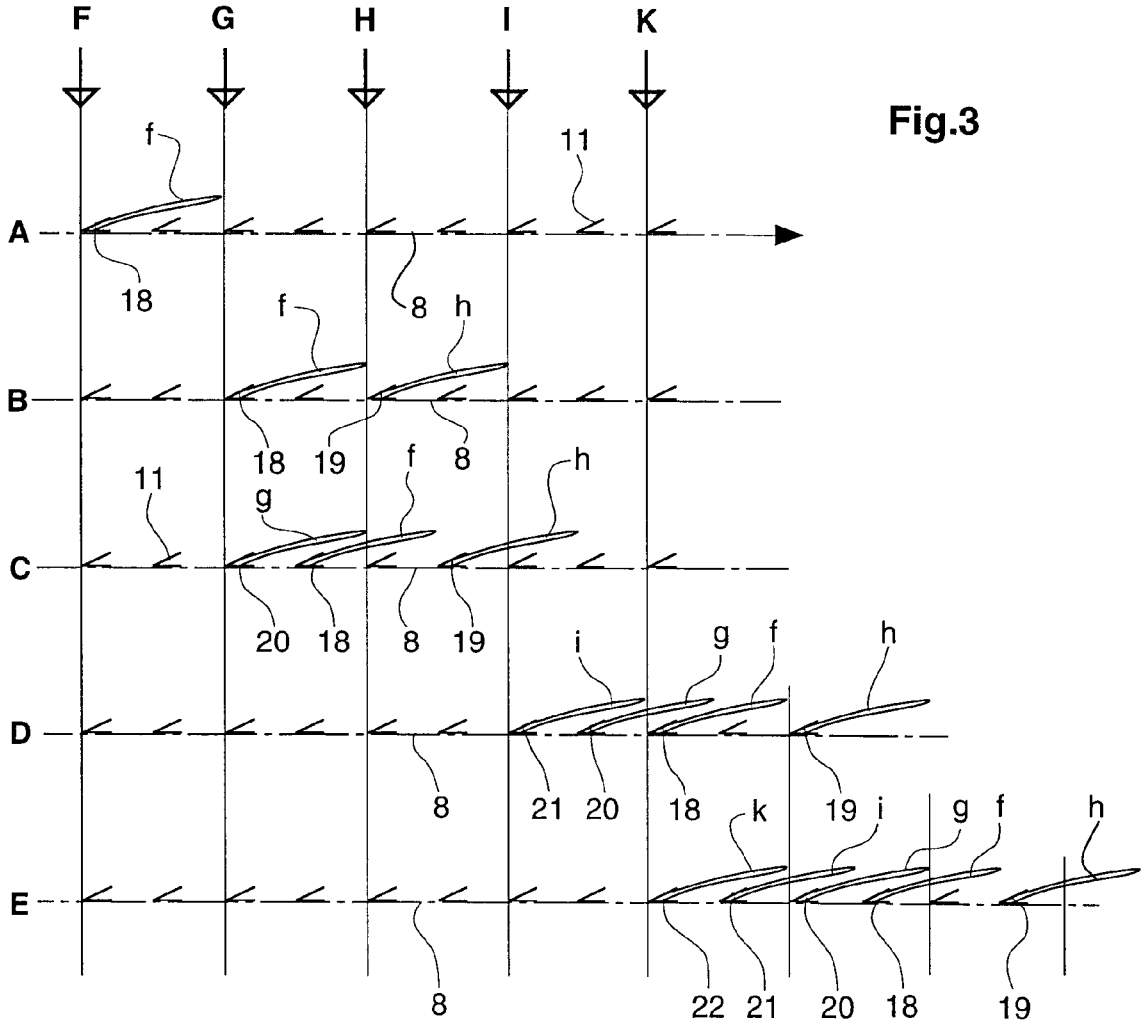
Figure 7:
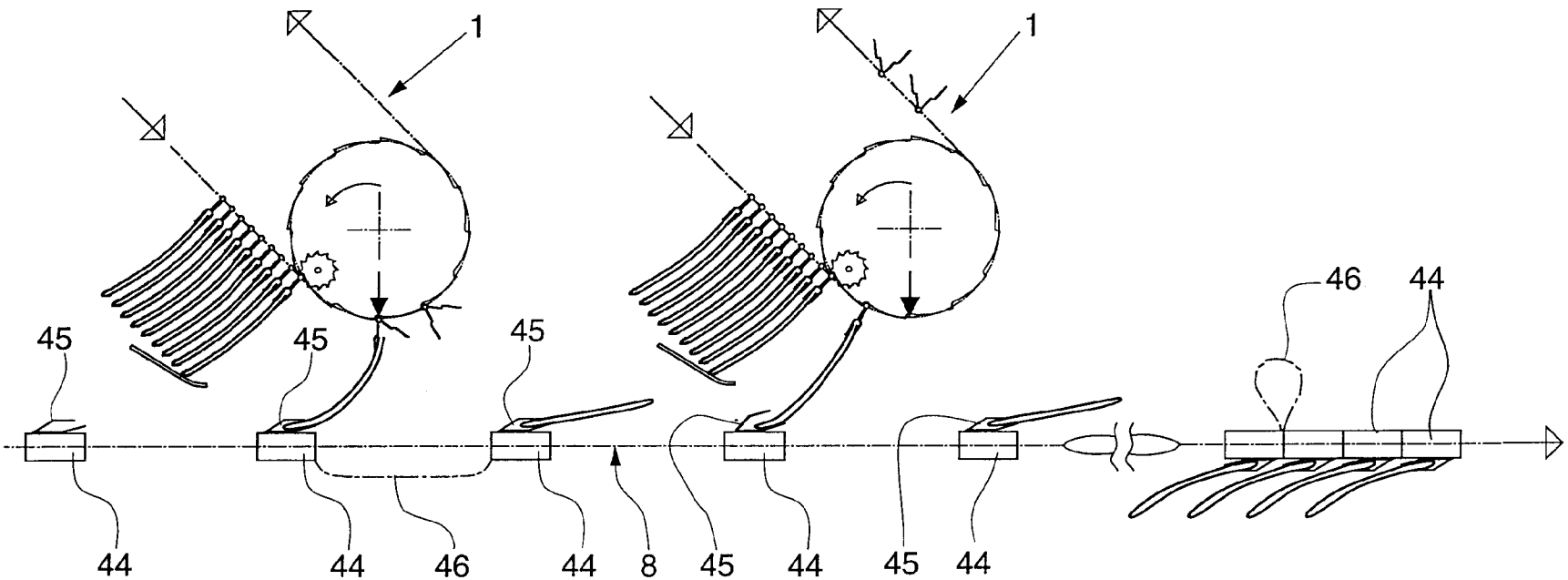
Figure 8:
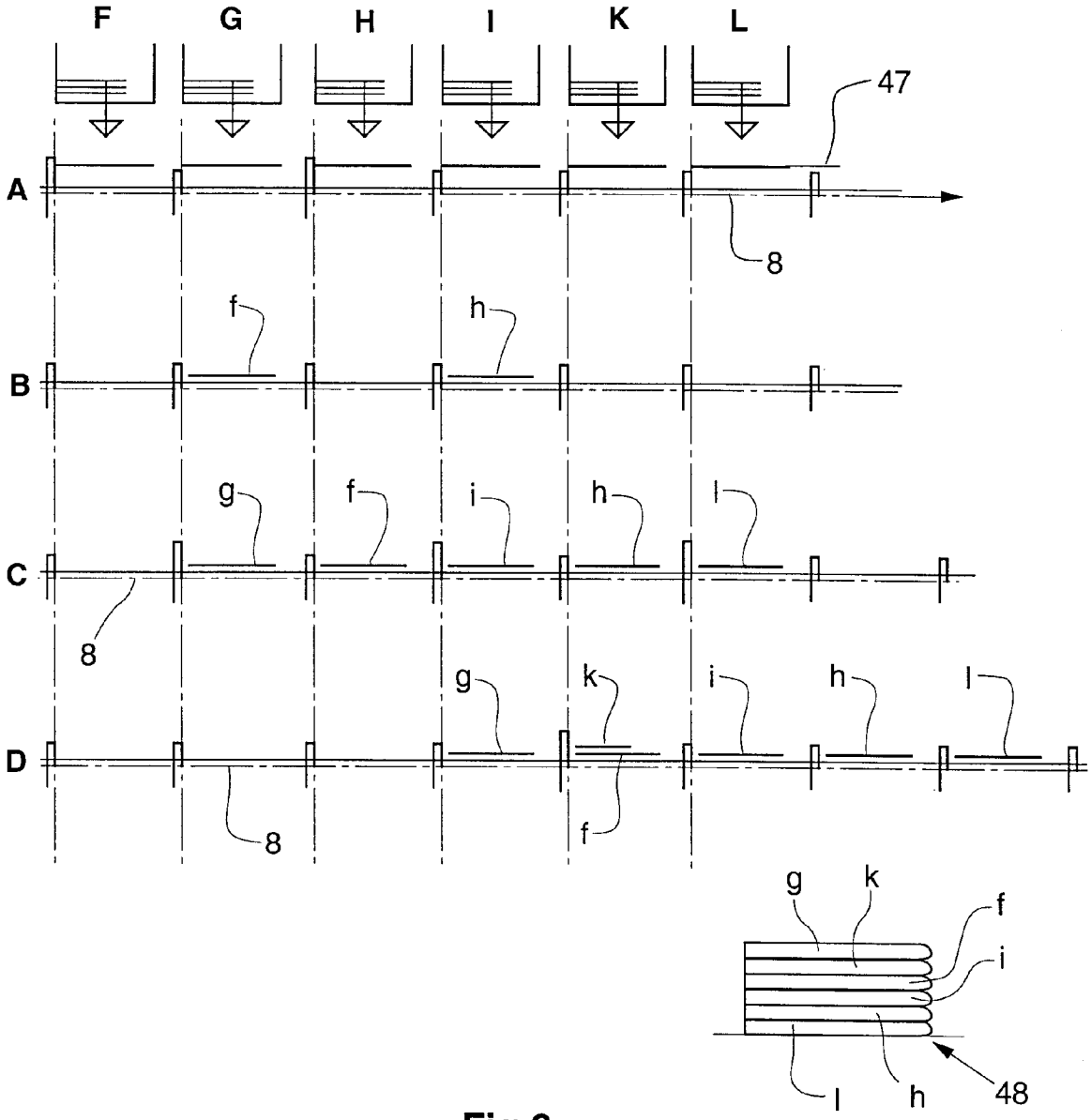
Figure 9:
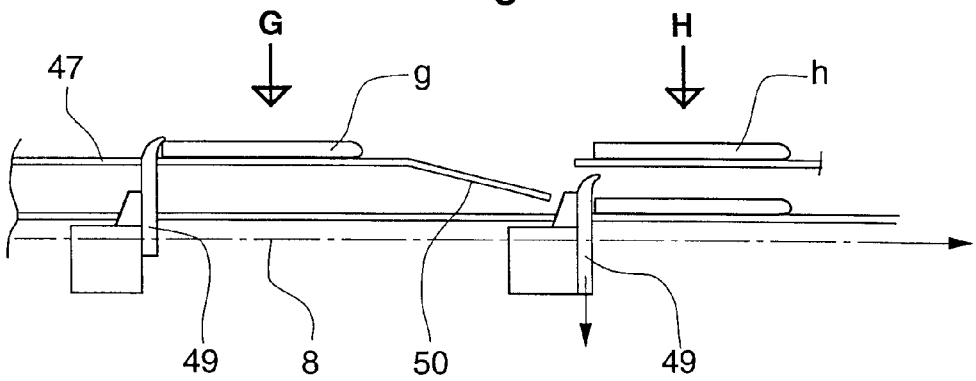

The invention is described hereinbelow by way of exemplary embodiments and with reference to the drawings, in which:

FIG. 1 shows a schematic view of the transfer region of a storage arrangement arranged above a receiving conveyor, FIG. 2 shows a schematic view of a plurality of storage arrangements according to FIG. 1, said storage arrangements being arranged along a receiving conveyor, FIG. 3 shows the schematic view of a first variant of a process according to the invention taking place in five process steps, FIG. 4 shows the schematic view of a second variant of a process according to the invention taking place in five process steps, FIG. 5 shows the schematic view of a third variant of a process according to the invention taking place in five process steps, FIG. 6 shows a process step according to a fourth variant of the process according to the invention, FIG. 7 shows a schematic view of an apparatus which is suitable for carrying out the process according to the invention and has a receiving conveyor which is modified in relation to FIG. 2, FIG. 8 shows a schematic view of a further apparatus which is suitable for carrying out the process according to the invention, including four process steps, and FIG. 9 shows an enlarged schematic view of a feed or transfer station used in conjunction with an apparatus according to FIG. 8.

DETAILED DESCRIPTION OF THE PREFERRED EMBODIMENTS

FIG. 1 shows a storage arrangement 1 with clamps 3 which are arranged along a guide path 2 and are each suitable for receiving completed printed products 4.

The guide path 2 runs in part along a transporting wheel 5 which is provided, on its outer circumference, with toothing elements 6 which are suitable for forcing the clamps 3 in the direction of circulation of the transporting wheel 5.

In that region in which the guide path 2 extends in the transporting direction into the direction of the circumference of the guide wheel 5, there is provided a toothed retrieval wheel 7 by means of which it is possible for individual clamps 3 to be assigned cyclically, if required, in each case to a toothing element 6 of the transporting wheel 5 and thus to be retrieved from the storage arrangement 1.

The distance between the clamps 3 along the guide path 2 is variable, with the result that the clamps 3 occupied by printed products 4 can follow one after the other more closely upstream of the transporting wheel 5, as seen in the transporting direction, than the empty clamps 3 which are transported away from the transporting wheel 5 along the guide path 2. This makes it possible to achieve a maximum storage capacity for the storage arrangement 1 and the quick supply, caused by the short conveying path, of printed product 4 for the next retrieval.

In order to retain in a defined position in the storage arrangement 1 the printed products 4 which are to be retrieved, a guide means 2' is arranged in the retrieval region of the storage arrangement 1, and this guide means allows the defined and reliable transfer of printed products 4 from the storage arrangement 1 to a receiving conveyor 8 arranged beneath the storage arrangement.

Provided in the bottom region of the transporting wheel 5 is an opening guide means which is marked by the arrow 9 and ensures that the clamps 3 running past it are opened and thus that printed products 4 are transferred to the receiving conveyor 8.

The receiving conveyor 8 comprises grippers 11 which can be transported one after the other in the direction of the arrow 10 and are in contact with one another and are thus spaced apart from one another by the smallest possible distance.

Upstream of the transfer region between the storage arrangement 1 and receiving conveyor 8, the grippers 11 are opened and are thus ready for receiving a printed product 4. When a printed product 4 is received from a clamp 3 of the storage arrangement 1, the grippers 11 are closed in order reliably to retain the product received in this way. Alternatively, however, it is likewise possible for the grippers to be kept open even once a printed product 4 has been received, with the result that, at a later point in time, possibly one or more further products may be introduced into grippers 11 which are already occupied by printed products 4. In the last-mentioned case, the gripper 11 is only closed once the receiving operation has been completed.

The particular advantage with the arrangement illustrated is that the printed products 4 retained in the grippers 11 overlap one another with the highest possible degree of overlap in imbricated formation, with the result that the capacity of the receiving conveyor 8 is utilized to the best possible extent.

Furthermore, the transfer principle which is illustrated in FIG. 1, and in the case of which printed products 4 are transferred directly from clamps 3 of the storage arrangement 1 to grippers 11 of the receiving conveyor 8, provides the advantage that said transfer can take place in a very short region of the receiving conveyor 8. This advantage is also brought about, inter alia, by the fact that the printed products 4 which are retained in the grippers 11 swing over forward in the transporting direction of the receiving conveyor 8, which means, inter alia, that it is possible for the printed products 4, which are oriented in a sloping manner during the transfer process, can be gripped, at their ends which are directed away from the clamps 3, conveniently and quickly by the grippers 11 without grippers 11 and printed products 4 having to be moved together, parallel to one another, over a relatively long stretch.

FIG. 2 shows three storage arrangements 1 according to FIG. 1, said storage arrangements following one after the other in the conveying direction of the receiving conveyor 8. This figure clearly shows that the advantageous configuration of the storage arrangements 1 and the transfer process of printed products 4 from the storage arrangements 1 to the receiving conveyor 8 allows the storage arrangements 1 to be spaced apart from one another by a comparatively small distance, which means that the entire receiving process can take place on a comparatively short stretch of the receiving conveyor 8. The distance between adjacent grippers 11 is considerably smaller than the distance between two storage arrangements 1 which follow one after the other.

It can also be seen from FIG. 2 that, in accordance with the process according to the invention, not all the grippers 11 are occupied by printed products 4 in the region of the receiving conveyor 8, which results in gaps 14, 15 being provided between printed products 4 which have already been deposited in grippers 11, it being possible for said gaps still to be occupied by further printed products 4. The gap 14 shown in FIG. 2 may be occupied, for example, by two further printed products, it being possible for this gap to be occupied via the central and/or right-hand storage arrangement 1 according to FIG. 2. However, it is only possible for the gap 14 to be occupied by two printed products 4 when first of all the leading gripper 12 and then the trailing gripper 13 are occupied, since otherwise a printed product retained in the gripper 13 would overlap the gripper 12 such that it would no longer be possible for any further product to be introduced into the gripper 12.

In the region of the gap 16, a further printed product 4 may be fed merely by the right-hand storage arrangement 1 according to FIG. 2.

The gap 16, which is illustrated in the right-hand region of the receiving conveyor 8, may no longer be occupied by further printed products 4 since the two empty grippers 17 producing the gap 15 are overlapped by the printed product 4 of the gripper following said grippers 17.

FIG. 3 shows five process steps A to E of a process according to the invention. For all the process steps in each case there is a schematic illustration of the receiving conveyor 8 with grippers 11 which may be occupied by printed products. Provided along the receiving conveyor 8 are five storage arrangements, which are symbolized merely by arrows F, G, H, I, K, may be designed, for example, according to FIG. 1 and, for reasons of clarity in FIG. 3, are only depicted in conjunction with the process step A.

In the process illustrated in FIG. 3, it is assumed that the printed products stored in the different storage arrangements differ from one another, but that only products of one type are stored in each storage arrangement. Hereinbelow, the products of the storage arrangement F are designated f, those of the storage arrangement G are designated g and those of the storage arrangements H, I and K are correspondingly designated h, i and k. These designations also apply to the FIGS. 4 to 6, which are explained hereinbelow.

In the process step A, apart from the gripper which is at the rear in the conveying direction, none of the grippers 11 of the receiving conveyor 8 is occupied by printed products; it is only the gripper 18, which is at the rear in the conveying direction, which has been occupied by a product f, which has been retrieved from the storage arrangement F.

In the process step B, the product f has been conveyed further as far as the region of the storage arrangement G. Also in this process step, a product h is transferred from the storage arrangement H to the gripper 19. In this case, the gripper 19 is located upstream of the gripper 18, as seen in the conveying direction, which is occupied by the product f. Clearly, the product h could likewise be deposited in the manner described if products had already been deposited in those grippers which precede the gripper 19. In this case, the product h would then be deposited not just upstream of, but also between, products which have already been deposited, in the region of a gap.

In the process step C, the products f, h located in the receiving conveyor 8 are transported further, in relation to the process step B, by the distance between two adjacent grippers, the process step C involving the transfer of a product g from the storage arrangement G to the gripper 20, which immediately follows the gripper 18.

In the process step D, the grippers 18 to 20 have been moved along the receiving conveyor 8 to such an extent that the gripper 20 is located between the two storage arrangements I and K. In this position, there is a further transfer of a product i from the storage arrangement I to the gripper 21.

In the process step E, the gripper 21, which is occupied by the product i, has already passed the storage arrangement K and there is a further discharge of a product from the storage arrangement K to the gripper 22, which is immediately downstream of the gripper 21. Following the process step E, a total of five products which follow one after the other in the sequence h, f, g, i and k are thus located on the receiving conveyor 8, this sequence, on account of the use of the process according to the invention, not corresponding to that sequence in which the storage arrangements F, G, H, I and K are arranged along the receiving conveyor 8.

At the end of the receiving conveyor 8, the products which follow one after the other can easily be formed into a stacked bundle 23 in which the individual products follow one after the other in the sequence h, f, g, i and k.

FIG. 4 shows a further variant according to the invention for combining printed products.

In the process step A, a product f is transferred from the storage arrangement F to the gripper 24.

Up to the process step B, the gripper 24 is transported into the region between the two storage arrangements H and I, in which position a product h is transferred from the storage arrangement H to the gripper 25, which is arranged directly downstream of the gripper 24.

When the gripper 25, in the process step C, comes to rest in the region of the storage arrangement I, a product g is discharged from the storage arrangement G to the gripper 26, which is arranged downstream of the gripper 25, as seen in the conveying direction, although there is a total of three further grippers 27, 28, 29 which are provided between the two grippers 25 and 26 and none of which is occupied by any product. The gripper 27 is overlapped in this case by the product g, which is retained in the gripper 26, with the result that it is not then possible for any further transfer of products to the gripper 27 to take place.

In the process step D, the gripper 29, which is arranged downstream of the gripper 25 with the product h, is located in the region of the storage arrangement K and, in this position, a product k is transferred from said storage arrangement K to the gripper 29. This transfer thus takes place into a gap between the two products g and h, which are retained in the grippers 26 and 25.

Between the process steps D and E, the product g is transferred from the storage arrangement G to the gripper 30, which is arranged downstream of the gripper 26.

In the process step E, the simultaneous transfer then takes place of a product f from the storage arrangement F to the gripper 31 and of a product i from the storage arrangement I to the gripper 32. The gripper 32 is arranged immediately downstream of the gripper 26, with the result that, here too, transfer takes place into a gap between the two grippers 26 and 30.

At the end of the receiving conveyor 8, the products f, h, k, g and i, which are retained in the grippers 24, 25, 29, 26 and 32, are combined into a bundle 33 in which the individual products follow one after the other in the above-mentioned sequence. The products g and f, which follow said products in the region of the receiving conveyor and are retained in the grippers 30 and 31, are already assigned to a second bundle, which differs from the bundle 33 in terms of structure and composition.

FIG. 5 shows a variant of the process according to the invention, in which two bundles which follow one after the other and are of the same type are combined, the sequence of the products within the bundles corresponding to the sequence of the storage arrangements which follow one after the other along the receiving conveyor.

In the process steps A and B, the two products f and g are transferred to grippers 34, 35 which follow one after the other.

In the process step C, there is simultaneous discharge of a product h from the storage arrangement H to the gripper 36 and of a product f from the storage arrangement F to the gripper 37. The gripper 36 immediately follows the gripper 35, and located between the grippers 36 and 37 is a total of three grippers 38, 39, 40 which, in the process step C, are still not occupied by any products.

Then, in the process step D, there is simultaneous discharge of a product i from the storage arrangement I to the gripper 40 and of a product g from the storage arrangement G to the gripper 41. The gripper 40 is immediately downstream of the gripper 36, and the gripper 41 is immediately downstream of the gripper 37. The product i is discharged in this case into a gap between the products f (gripper 37) and h, said products already being located on the receiving conveyor 8.

In the process step E, finally, there is simultaneous discharge of a product k to the gripper 39, which is immediately downstream of the gripper 40, and of a product h to the gripper 42, which is immediately downstream of the gripper 41. The product k is thus likewise positioned, in the process step E, in a gap between the two products i and f (gripper 37).

The products f, g, h, i and k which follow one after the other in the grippers 34, 35, 36, 40 and 39 at the end of the receiving conveyor 8 form a first bundle 43, and the products f, g and h which follow said products in the grippers 37, 41 and 42 form the start of a further bundle, which will ultimately have the same structure as the first bundle. The empty gripper 38 is located between the two bundles, with the result that there is a gap between the two bundles, and this makes it easier for the products to be processed further in bundle form at the end of the receiving conveyor 8.

FIG. 6 illustrates that, in certain cases, it is also possible for in each case one product to be discharged simultaneously from all the storage arrangements to the grippers of the receiving conveyor 8, which then results in the products along the receiving conveyor 8 being in a sequence which is the reverse of that in the process according to FIG. 5. In the case of this simultaneous discharge of products according to FIG. 6, there is always an empty gripper located between two adjacent products, this empty gripper being overlapped by the product following the empty gripper. Thus, according to FIG. 6, it is indeed possible for products to be discharged very quickly to the receiving conveyor, but it is necessary to have, on the receiving conveyor, double the amount of space as in the case of the process according to FIG. 5.

FIG. 7 shows an arrangement which is intended for carrying out the process according to the invention and is modified in relation to FIG. 2, although use is made here of the same storage arrangements 1. The modification in relation to the apparatus according to FIG. 2 is found in the region of the receiving conveyor, which, according to FIG. 7, comprises carriages 44 which follow one after the other and are each coupled to a gripper 45.

The carriages 44 are connected to one another, for example, via flexible elements 46 (only schematically illustrated in FIG. 7) and follow one after the other at least in an essentially equidistant manner in that region of the receiving conveyor 8 in which products are transferred from the storage arrangements 1. The distance between adjacent carriages 44 corresponds here to the length of the flexible elements 46 in their extended state.

Once the carriages 44 have passed the last storage arrangement 1 in the conveying direction, the carriages 44 may be rotated through 180° about an axis directed parallel to the conveying direction of the receiving conveyor 8, with the result that, as is illustrated in the right-hand region of FIG. 7, the products received hang downward. At the same time, the grippers 45 may be pivoted in relation to the carriages 44, with the result that the products slope rearward—rather than forward, as in the region of the storage arrangements 1. Furthermore, on account of their flexible coupling, adjacent carriages 44 may be arranged closely to one another to the extent that they are in contact with one another, which advantageously means that only a small amount of space is then required for the same number of products to be transported. In this way, it is possible for the combined products, even if they are not combined to overlap one another, then to be processed further in an imbricated formation with mutual overlapping.

FIG. 8 shows a further apparatus which is suitable for carrying out the process according to the invention. This figure shows a total of six storage arrangements F to L which are arranged along a receiving conveyor 8 designed as a conveying belt. A number of identical products f to l are stored in each storage arrangement. These products f to l may be retrieved individually, from the storage arrangements F to L, into the region of a standby plane 47, from where they may be fed to the conveying belt of the receiving conveyor 8.

Between the process states A and B, two products f and h from the storage arrangements F and H are received simultaneously by the receiving conveyor 8 from the region of their respective standby plane 47.

Between the process state B and the process state C, the two products f and h are transported further by a distance which corresponds to the distance between two adjacent storage arrangements F to L.

Then, in the process state C, in each case one product g, i and l is discharged from the storage arrangements G, I and L. This produces the product sequence l, h, i, f and g on the receiving conveyor 8.

This product sequence is then transported further, between the process states C and D, by a distance which corresponds to double the distance between the adjacent storage arrangements F to L.

Then, in the process state D, a product k is discharged from the storage arrangement K, said product k coming to rest on the product f, which has already been deposited. It can thus be seen that a receiving position of the receiving conveyor 8 may also be suitable for receiving two or more products, as long as the sequence of the products deposited in a receiving position fits in with the ultimately desired sequence of the products in the bundle.

This also applies to the grippers which have been explained in conjunction with FIGS. 1 to 7, which may be conveyed along the receiving conveyor in an open state and are thus also suitable, in principle, for receiving a plurality of products.

A bundle 48 is then combined in the sequence l, h, i, f, k and g at the end of the receiving conveyor 8.

FIG. 9 shows, on an enlarged scale, the product-transfer region of an apparatus according to FIG. 8.

It can be seen from this illustration that, for example, products g and h come to rest individually in the region of the standby plane 47 and are gripped there by protrusions 49 conveyed horizontally along the receiving conveyor 8, as a result of which the products g, h come to rest on the receiving conveyor 8 along a sloping surface 50. In order to make it possible for products which are located in the standby plane 47 to be retrieved on an optional basis, the protrusions 49 can be vertically controlled and displaced, with the result that they can be drawn back out of the standby plane 47, this leading to the situation where the protrusions 49 can run past products located in the standby plane 47 without the products being carried along by the respective protrusion 49.

What is claimed is:

1. A process for combining a plurality of completed printed end products, such as newspapers or periodicals, into bundles or stacks, comprising the steps of:

occupying at least two storage arrangements with printed end products of different types, individually retrieving the printed end products from the storage arrangements in a sequence required for forming a bundle or stack of a particular type, providing a receiving conveyor which comprises a plurality of receiving positions which follow one after the other, with each receiving position being configured for receiving one or more of the products, feeding the retrieved end products to the receiving conveyor with certain of the retrieved end products being positioned upstream of or between end products which have already been fed to the receiving conveyor, and wherein the feeding step includes dimensioning and orienting the individual end products in the region of the receiving conveyor such that, once they have been fed to a receiving position, they overlap at least one adjacent receiving position, and combining or stacking the end products which follow one after the other on the receiving conveyor into bundles or stacks.

2. The process as claimed in claim 1, wherein the receiving positions follow one after the other in an equidistant manner.

3. The process as claimed in claim 1, wherein the step of feeding the retrieved end products to the receiving conveyor includes actively retaining each end product in a receiving position.

4. The process as claimed in claim 3, wherein the step of actively retaining each end product in a receiving position includes retaining each end product by clamping means.

5. The process as claimed in claim 3, wherein the step of actively retaining each end product in a receiving position includes retaining each end product from beneath.

6. The process as claimed in claim 1, wherein the step of feeding the retrieved end products includes controlling the feeding such that the end products are transferred in each case to free receiving positions which are not yet occupied by an end product.

7. The process as claimed in claim 1, wherein, before products have been combined into bundles or stacks, the time sequence in which the end products are transferred from the individual storage arrangements to the receiving conveyor is determined, or calculated by means of an optimization algorithm, for each storage arrangement in dependence on the occupancy of the latter by products, the position thereof on the receiving conveyor and the desired combination of the bundles or stacks which are to be produced.

8. The process as claimed in claim 1, wherein the feeding step includes creating gaps on the receiving conveyor between individual end products and subsequently feeding at least one further end product in the region of the gaps so created.

9. The process as claimed in claim 1, wherein the feeding step includes producing a gap in the region of the receiving conveyor between the last product of one bundle or stack and the first product of a bundle or stack following said one bundle or stack.

10. The process as claimed in claim 1, wherein the feeding step includes creating gap sections specifically between individual end products or the receiving conveyor in order for end products assigned to at least one complete bundle or stack to be fed subsequently in the region of the gap sections produced.

11. The process as claimed in claim 1, wherein the products overlap at least one adjacent receiving position in the conveying direction of the receiving conveyor.

12. The process as claimed in claim 1, wherein the feeding step includes controlling the end products such that the end products are transferred in each case to free receiving positions not yet occupied by an end product or not overlapped by an end product.

13. The process as claimed in claim 1, wherein each receiving position is assigned three different states, namely the "free", "occupied" or "overlapped" states.

14. The process as claimed in claim 1, wherein, before the products are combined into bundles or stacks, the time sequence in which the end products are transferred from the individual storage arrangements to the receiving conveyor is determined, or calculated by means of an optimization algorithm, for each storage arrangement in dependence on the occupancy of the latter by end products, the position thereof on the receiving conveyor, the dimensions of the end products and the correspondingly produced receiving position overlaps, and the desired combination of the bundles or stacks which are to be produced.

15. The process as claimed in claim 1, wherein the feeding step includes positioning the end products on the receiving conveyor such that, once they have passed the last storage arrangement in the conveying direction, they overlap one another.

16. The process as claimed in claim 1, wherein the receiving positions of the receiving conveyor are spaced apart from one another by a distance which is smaller than the distance between successive storage arrangements.

17. The process as claimed in claim 1, wherein the receiving positions of the receiving conveyor are spaced apart from one another by the smallest possible distance.

18. The process as claimed in claim 1, wherein the storage arrangements along the receiving conveyor are spaced apart from one another by the smallest possible distance.

19. The process as claimed in claim 1, wherein only end products of one type are stored in each storage arrangement.

20. The process as claimed in claim 1, wherein at least two different end products are contained in each-bundle or stack.

21. The process as claimed in claim 1, wherein different bundles or stacks contain different numbers of end products.

22. The process as claimed in claim 1, comprising the further step of combining different bundles or stacks in which the type and/or sequence of end products which follow one after the other within a bundle or stack differ from one another.

23. The process as claimed in claim 1, wherein the step of occupying at least two storage arrangements with printed end products includes retaining the end products in the region of the storage arrangements in product receiving means provided in each case for receiving just a single end product.

24. The process as claimed in claim 23, wherein the product receiving means comprises clamping means.

25. The process as claimed in claim 23, wherein the product receiving means of the storage arrangements are spaced apart from one another by the smallest possible distance.

26. The process as claimed in claim 1, wherein the feeding step includes transferring the end products directly from product receiving means of the respective storage arrangement to receiving positions of the receiving conveyor.

27. The process as claimed in claim 1, wherein the step of individually retrieving the printed end products includes signaling the storage arrangements with a joint transfer clock signal so as to synchronize retrieval of the end products.

28. The process as claimed in claim 1 comprising the further preliminary step of forming the completed end products by combining product parts.

* * * * *